United States Patent [19]

Curtis et al.

[11] Patent Number: 5,076,194

[45] Date of Patent: Dec. 31, 1991

[54] KAYAK SAFETY DECK SYSTEM

[76] Inventors: Richard M. Curtis, 51 Stanworth La., Princeton, N.J. 08540; Thomas G. Kreutz, 140 Quaker Rd., Princeton, N.J. 08540

[21] Appl. No.: 563,533

[22] Filed: Aug. 6, 1990

[51] Int. Cl.[5] ..... B62B 19/00

[52] U.S. Cl. ..... 114/347; 114/361

[58] Field of Search ..... 114/347, 361, 364, 345, 114/343, 351

[56] References Cited

U.S. PATENT DOCUMENTS

| | | | |
|---|---|---|---|
| 4,583,480 | 4/1986 | Hamilton et al. | 114/347 |
| 4,699,076 | 10/1987 | Curtis et al. | 114/347 |
| 4,727,821 | 3/1988 | Masters | 114/347 |

FOREIGN PATENT DOCUMENTS

| | | | |
|---|---|---|---|
| 507952 | 9/1930 | Fed. Rep. of Germany | 114/347 |
| 1277696 | 9/1968 | Fed. Rep. of Germany | 114/347 |

*Primary Examiner*—Jesûs D. Sotelo
*Assistant Examiner*—Stephen P. Avila

[57] ABSTRACT

A kayak or similar watercraft includes a releasable deck section that allows the operator to easily evacuate the craft during an emergency. A flange on the removable deck section interlocks with a flange on the hull of the watercraft. Forward pressure exerted by the operator on the releasable deck section causes the deck section to slide forward until it is no longer interlocked with the hull flange, thereby releasing the deck section from the watercraft. The purpose of the invention is to facilitate entry into and emergency exits from the watercraft.

8 Claims, 4 Drawing Sheets

KAYAK SAFETY DECK SYSTEM

BACKGROUND OF THE INVENTION

1. Field of the Invention

The invention relates to a releasable deck plate for use with a kayak or similar watercraft to allow the operator of the craft to quickly and safely evacuate the cockpit during an emergency.

2. Description of the Prior Art

The present invention provides a means by which the paddler can more easily remove his legs from the craft to avoid entrapment. This is achieved in the preferred embodiment through the introduction of a manually releasable, removable foredeck section into the kayak which, when removed, substantially increases the size of the cockpit. In order to be useful to the whitewater paddler, the removable foredeck should fulfill three criteria. First, it must be rigidly attached to the rest of the boat during normal operation in order to provide structural strength to the kayak. This also allows the paddler to brace his knees for maneuvering and Eskimo rolling. Secondly, the removable foredeck must be manually releasable in such a way as to separate from the craft only when actuated by the paddler. Thirdly, the removable foredeck must be easily releasable by the paddler during common pinning situations.

Prior art relating to emergency egress from kayak-type craft fail to meet these requirements. The patent of Brock (U.S. Pat. No. 1,792,140) describes a sectional foredeck which opens automatically when the boat turns upside down. The patent of Von Moltke (DM 536,699) describes a flexible, sealed spraydeck which rolls open automatically when the boat is turned over. The patent of Hart (DM 507,952) describes a flexible deck with stiffeners which can be lifted up by the paddler and which also opens automatically when the boat is turned over. The patent of Masters (U.S. Pat. No. 4,520,747) describes a rigid deck, hinged at the front, and connected to the boat with flexible gaskets. The patent of MacKereth (GB 2 134 454 A) describes a rigid deck with a releasable system held in place by a cable system. The patent of Masters (U.S. Pat. No. 4,727,821) describes a detachable pod for the kayak operator to sit in.

All of these releasable deck systems suffer from severe shortcomings when applied to whitewater kayaks: 1) they can release inadvertently in non-emergency situations, (Brock, Hart, Von Moltke) and 2) they require a lifting force perpendicular to the plane of the removable foredeck section in order to release (Brock, Hart, MacKereth, Masters). These shortcomings are alleviated by the patents of Curtis et al. (U.S. Pat. No. 4,699,076;GB 2167353) and the present invention.

In devices which release automatically (Brock, Hart, Von Moltke), the paddler is forced to exit the craft and swim every time the craft is turned upside down. This can be extremely hazardous for the paddler. In addition, during normal whitewater paddling, the paddler and the kayak are routinely subjected to a wide variety of forces which are unpredictable and at times severe. The paddler is constantly being thrust up (or is bracing) against the underside of the foredeck, thereby causing such systems to release inadvertently. Inadvertent release of any sort is prevented by both the patents of Curtis et al. and the present invention, which describe a slidably releasable foredeck section which can only be released when actuated by the paddler.

Prior art which requires a lifting force perpendicular to the releasable foredeck section (Brock, Hart, MacKereth, Masters) fail to allow the paddler to exit his boat in many of the common whitewater pinning situations where oncoming water is pressing against the releasable foredeck section, a situation known as the broach. A broach occurs when the kayak is pressed broadside against an obstruction by the force of the current. In this situation the deck of the kayak often faces upstream, with the force of the current pressing directly against the deck surface. In the presence of such a force, (e.g. 300 kilograms of force on a boat with a current speed of 10 kilometers per hour), it is highly unlikely that a paddler would be able to actuate a device which requires that the foredeck cover be lifted in the direction of the oncoming current. The patents of Curtis et al. and the present invention, however, do not require a lifting force for release. Rather, both utilize a release force parallel to the deck for easy release even when a significant force is applied directly down onto the foredeck.

Like the patents of Curtis et al., the present invention describes a slidably releasable, manually operated releasable foredeck system. However, while Curtis et al. utilizes a multiplicity of attachment/release fasteners to connect the releasable foredeck section to the watercraft, the present invention is dramatically simpler, utilizing only a single fastener means which can be molded integrally with the watercraft. This single fastener means is more easily attached to the craft since only one fastener needs to be properly aligned. Moreover, the single fastener has superior water resistance because of the convoluted path that the water must travel in order to enter the watercraft. Finally, the shape of the single fastener means along the periphery of the extended cockpit opening augments the structural rigidity of the entire deck of the watercraft and of the releasable foredeck section.

SUMMARY OF THE INVENTION

Briefly described the invention comprises a releasable deck plate for use on a kayak or similar watercraft having a substantially rigid deck. According to the preferred embodiment, a removable foredeck section, the deck plate, is located directly forward of the kayak operator. The kayak operator normally sits in the cockpit with his knees directly under the releasable deck plate. The deck plate covers an extended cockpit opening such that when the deck plate is released a substantially larger cockpit opening is created allowing ease of operator exit. During normal operation the deck plate is rigidly attached to the kayak and is easily released by the operator but cannot be released inadvertently. The deck plate is released by means of a force applied parallel to the deck of the kayak. It does not require a lifting force for release and removal. The deck plate is attached to the kayak by means of a single fastener means which extends along the perimeter of the deck plate and the extended cockpit opening. This fastener means consists of interlocking flanges on both the deck plate perimeter and the perimeter of the extended cockpit opening. A sealing material is utilized with the fastener means to make the system watertight.

DETAILED DESCRIPTION OF THE PREFERRED EMBODIMENT

During the course of this description like numbers will be used to identify like elements according to the different figures which illustrate the invention.

Figure 1:
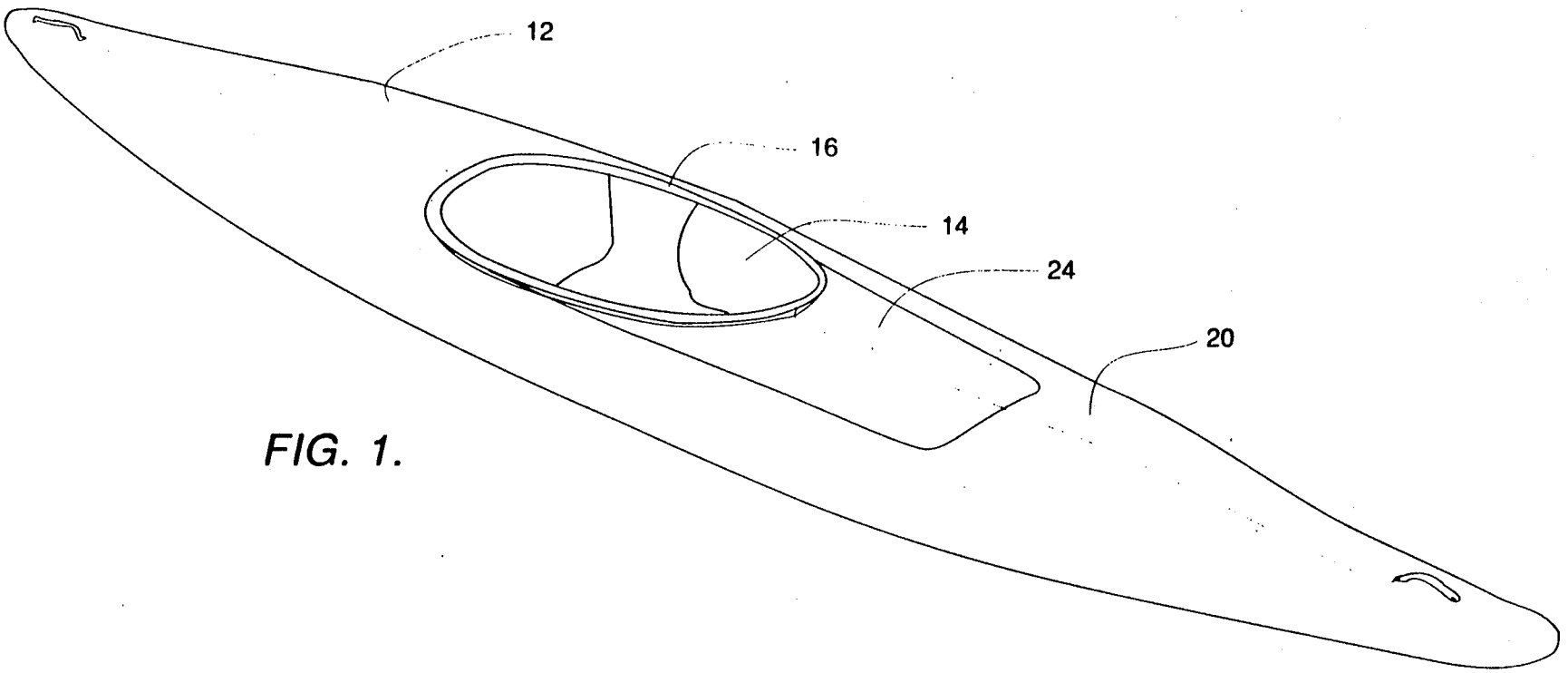
FIG. 1 is a perspective view of a decked water craft with a releasable deck plate section constructed according to the present invention.
Figure 2A:
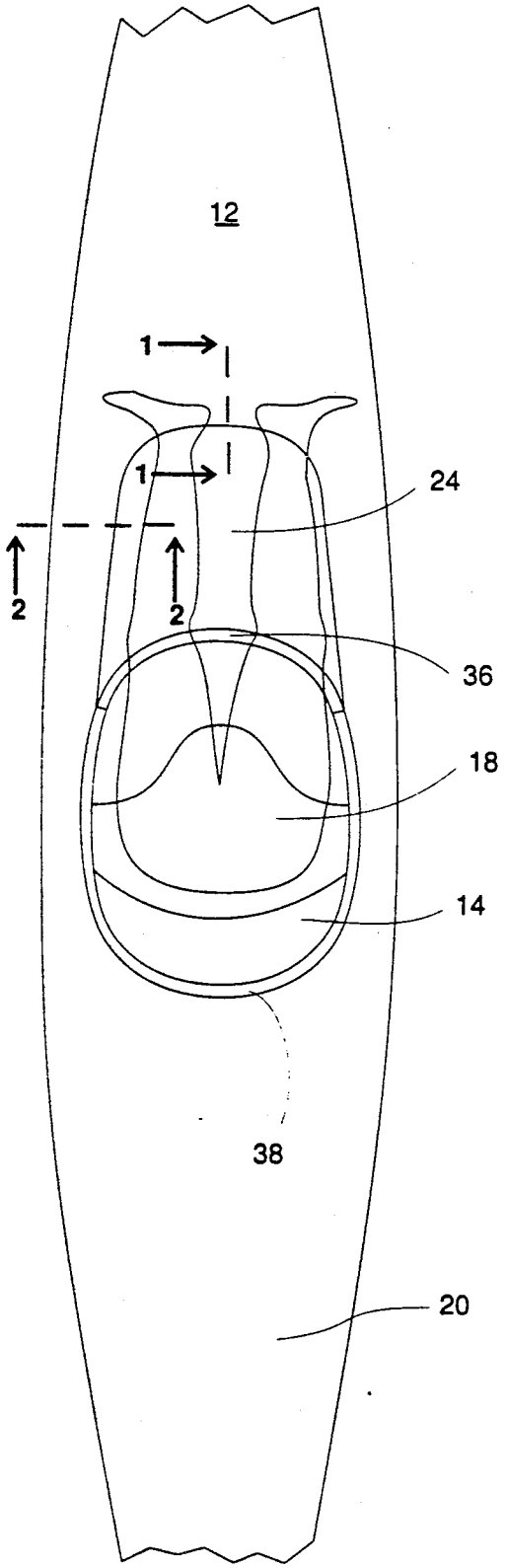
FIG. 2A is a top plan view of the preferred embodiment of the present invention showing the location of the operator's knees and legs with respect to the foredeck of the kayak; the deck plate is in the attached position.
Figure 2B:
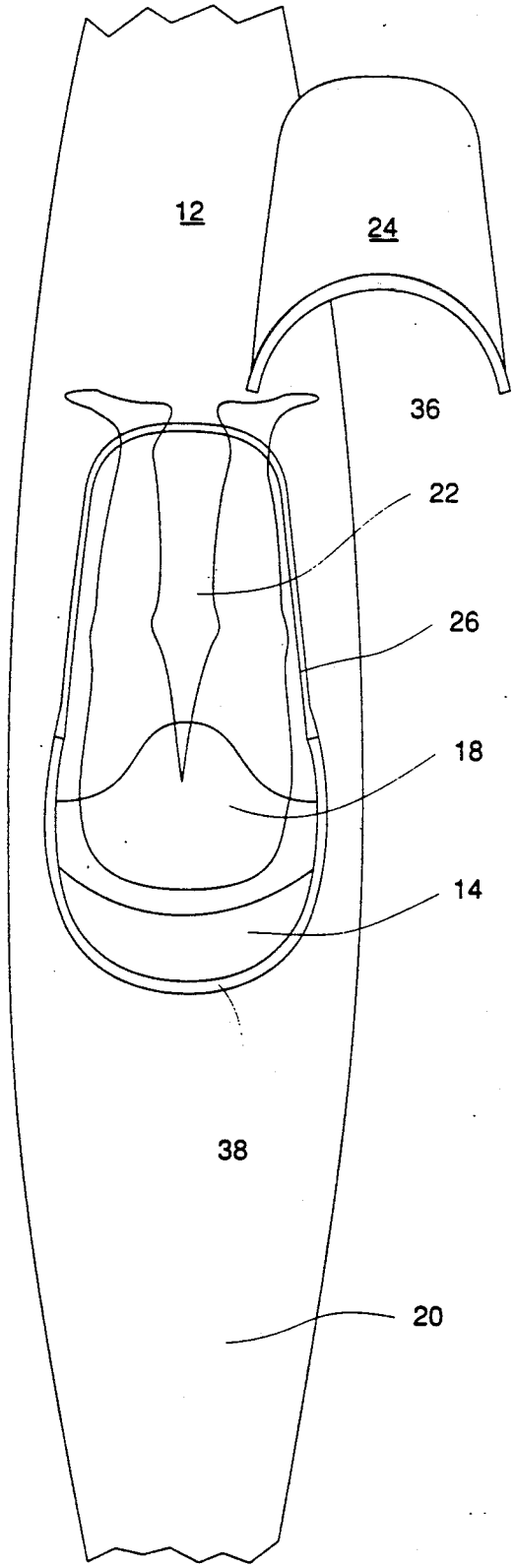
FIG. 2B is a top plan view of the preferred embodiment of the present invention showing the tapered shape of both the extended cockpit opening and the deck plate; the deck plate is shown unattached.
Figure 3:
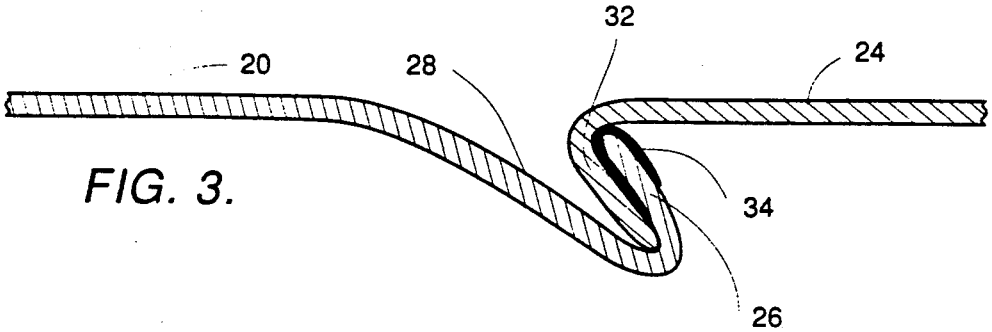
FIG. 3 is a cross-sectional cut away view taken along line 1—1 in FIG. 2A showing the interlocking attachment flanges on the front edges of both the extended cockpit opening and the deck plate when the deck plate is in the attached position.
Figure 4:
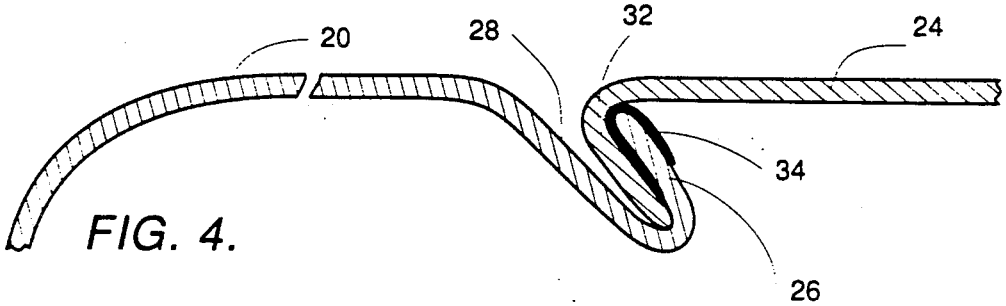
FIG. 4 is a cross-sectional cut away view taken along line 2—2 in FIG. 2A showing the interlocking attachment flanges on the left side of both the extended cockpit opening and the deck plate when the deck plate is in the attached position.
Figure 5A:
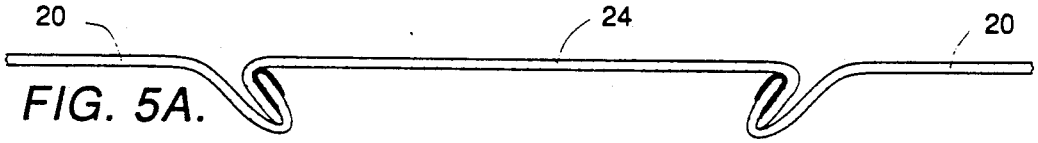
FIG. 5A is a cross-sectional cut away view taken along line 3—3 in FIG. 6A showing the interlocked, side flanges of the extended cockpit opening and the deck plate; the deck plate is shown in the attached position.
Figure 5B:
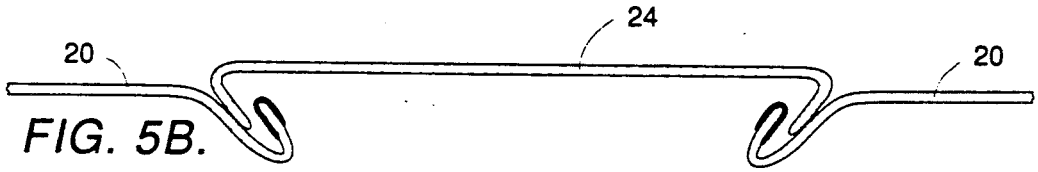
FIG. 5B is a cross-sectional cut away view taken along line 4—4 in FIG. 6B showing the side flanges of the extended cockpit opening and the deck plate; the deck plate has been pushed forward slightly and is in a semi-attached position.
Figure 5C:
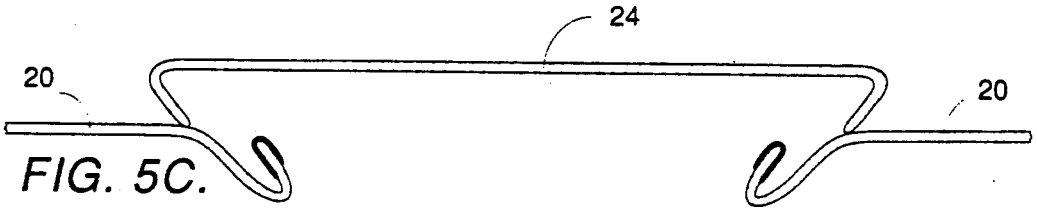
FIG. 5C is a cross-sectional cut away view taken along line 5—5 in FIG. 6C showing the side flanges of the extended cockpit opening and the deck plate; the deck plate has been pushed forward into the released position.
Figure 6C:
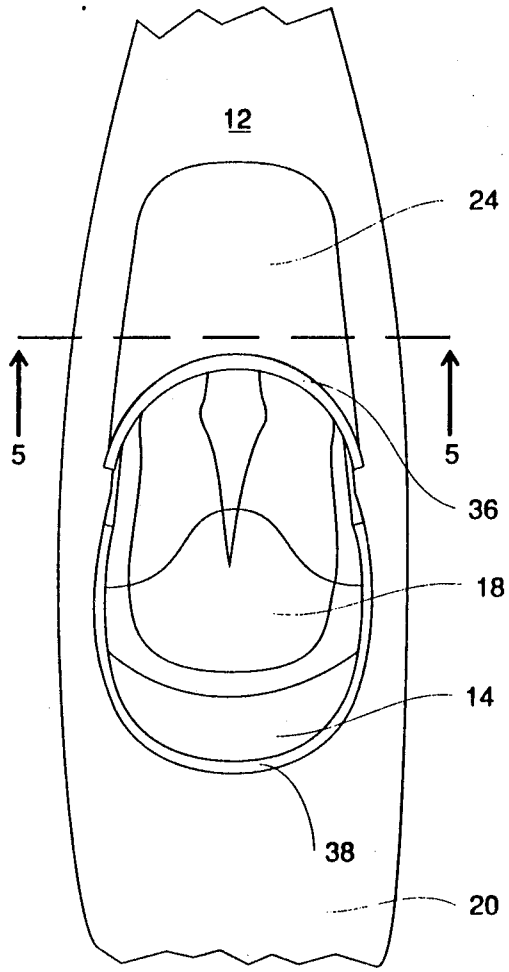
FIG. 6C is a top plan view of the cockpit, extended cockpit opening, and the deck plate; the deck plate has been pushed forward into the released position.
Figure 6B:
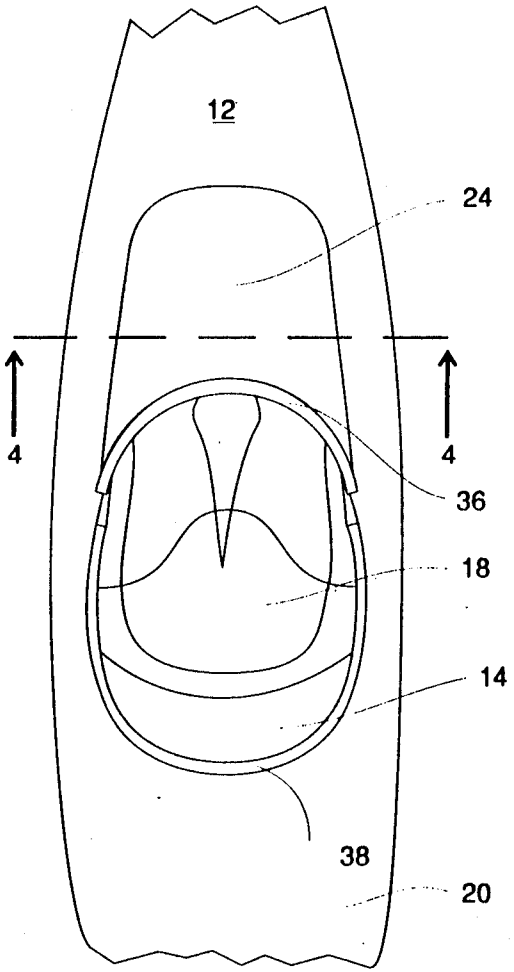
FIG. 6B is a top plan view of the cockpit, extended cockpit opening, and the deck plate; the deck plate has been pushed forward slightly and is in a semi-attached position.
Figure 6A:
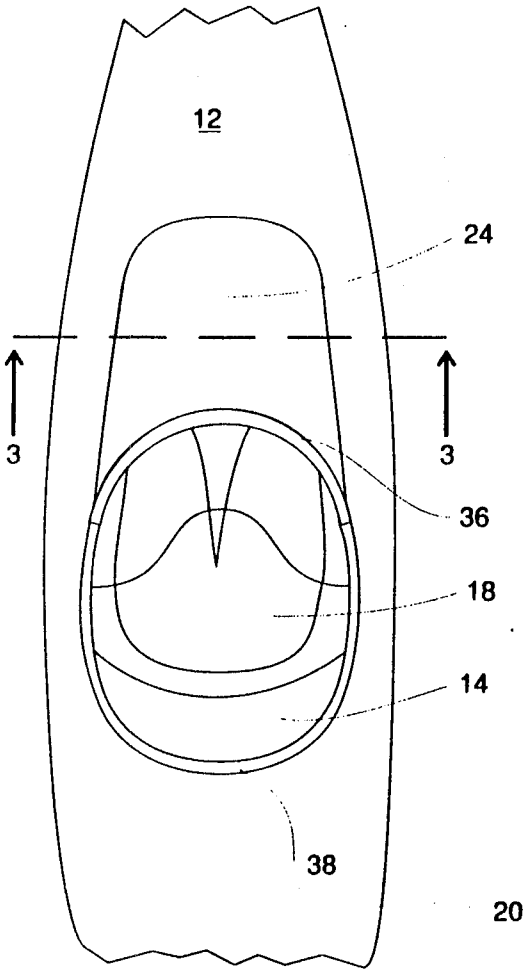
FIG. 6A is a top plan view of the cockpit, extended cockpit opening, and the deck plate; the deck plate is shown in the attached position.

FIG. 1 of the drawings illustrates a decked watercraft 12 which includes a cockpit opening 14 surrounded by a cockpit rim 16. The operator 18 is normally seated inside the watercraft 12 with his knees and legs extended beneath the hard upper surface 20 of the watercraft 12, as shown in FIG. 2A. The upper torso of the operator 18 is located above and outside of the cockpit opening 14. The size of the cockpit opening 14 is increased by the inclusion of an extended cockpit opening 22 which extends forward past the knees of the operator 18. As shown in FIGS. 2A and 2B, the extended cockpit opening 22 can be completely covered by an attachable and releasable, removable deck plate 24 whose size and shape are approximately equal to that of the extended cockpit opening 22. The shape of the extended cockpit opening 22 is slightly tapered so that its forward width is less than its rearward width. Along the edge of the extended cockpit opening 22 there is an attachment flange 26—hereafter referred to as the 'cockpit flange' 26—which protrudes upward and outward away from the center of the extended cockpit opening 22. In the preferred embodiment, the cockpit flange 26 is recessed below the level of the deck 20, as shown in FIGS. 3, 4, and 5. The portion of the deck 20 which is angled downward and is attached to the bottom of the cockpit flange 26 provides a ramp 28 which facilitates attachment and removal of the deck plate 24. The ramp 28 and the cockpit flange 26 comprise a slot (or female means) which receives the corresponding attachment flange 32 (or male means) on the deck plate 24. The deck plate flange 32 lies along both the side and front edges of the deck plate 24 and curves downward and inward toward the midpoint of the deck plate 24, as shown in FIGS. 3, 4, and 5.

When the deck plate 24 is in the attached position, the deck plate flange 32 is interlocked all along its length with the cockpit flange 26 as shown in FIGS. 3 and 4. A strip of resilient gasket material 34, which in the preferred embodiment is attached to the cockpit flange 26, lies between the cockpit flange 26 and the deck plate flange 32 when the deck plate 24 is in the attached position, thereby providing a watertight seal between the deck 20 and the deck plate 24. Protruding upward from the rear edge of the deck plate 24 is the forward portion of the cockpit rim 36. In the attached position, the forward cockpit rim 36 and the rear portion of the cockpit rim 38 are contiguous, entirely encircling the operator 18, as shown in FIG. 2A. In the attached position, the deck plate 24 cannot be moved with respect to the deck in any direction except forward for release. Side-to-side motion of the deck plate 24 is prevented by contact between the side portions of the deck plate flange 32 with the side portions of the cockpit flange 26 as illustrated in FIGS. 4 and 5A. Rearward movement of the deck plate 24 is prevented primarily by contact between the front portion of the deck plate flange 32 with the front portion of the cockpit flange 26 as illustrated in FIG. 3. Upward motion of the deck plate 24 is prevented by the overlap between the deck plate flange 32 and the cockpit flange 26.

The tapered shape of the extended cockpit opening 22 and the deck plate 24 provides for facile release of the deck plate 24. As the deck plate 24 is pushed forward by the operator 18 toward the released position, the overlap between the side portions of the deck plate flange 32 the side portions of the cockpit flange 26 decreases and, as a result, limited upward movement of the deck plate 24 becomes possible. As the deck plate 24 moves forward, it is also forced upward as a result of the contact between the bottom of the deck plate flange 32 and the ramp 28. This is illustrated sequentially in FIGS. 5A–6C which depict the relative positions of the extended cockpit opening 22 and the deck plate 24 as the deck plate 24 is pushed forward from the attached position to the released position. Note that the cross section of the deck plate 24—relative to the extended cockpit opening 22—appears to grow larger as the deck plate 24 is pushed forward. In the released position, shown in FIG. 5C, the deck plate flange 32 and the cockpit flange 26 are completely separated, and the deck plate 24 lies unattached above the level of the deck 20. From this released position, the deck plate 24 can be readily removed in any direction by the operator 18. The deck plate 24 is attached by placing it on the deck 20 slightly in front of the extended cockpit opening 22 and pulling it rearward. When properly aligned, the deck plate flange 32 becomes interlocked with the cockpit flange 26 as the deck plate 24 is pulled rearward.

The tapered shape of the extended cockpit opening 22 and the deck plate 24 insure that as the deck plate 24 is pushed forward, the overlap between the deck plate flange 32 and the cockpit flange 26 decreases. The degree of the taper controls how rapidly the deck plate 24 is released as it is pushed forward. For example, if both sides of the extended cockpit opening 22 are roughly linear in shape and tapered at an angle of 11.3 degrees with respect to the midline of the kayak (i.e. 1 cm sideways per 5 cm forward) and the overlap between the side portions of the cockpit flange 26 and the deck plate flange 32 is equal to 1 cm when the deck plate 24 is in the attached position, then there will be no overlap between the attachment flanges after the deck plate 24 has been pushed forward by 5 cm or more. If the angle of taper is greater than 11.3 degrees, then the deck plate 24 will become released more 'rapidly', i.e. after it has been pushed forward less than 5 cm. Conversely, if the angle of taper is smaller than 11.3 degrees, the deck plate 24 will require a push greater than 5 cm for release.

While the invention has been described with reference to the preferred embodiment thereof, it will be appreciated by those with ordinary skill in the art that various changes may be made to the elements and to the structure of the invention and the parts thereof, without departing from the scope of the invention as a whole.

We claim:

1. An apparatus comprising a releasable substantially rigid deck plate in combination with a watercraft having a bow, a substantially rigid upper deck and a cockpit opening, said cockpit opening comprising a hole in said rigid upper deck which surrounds the operator when the operator is seated in said watercraft and which allows operator entry into and exit from said watercraft, said apparatus comprising:

a substantially rigid deck plate means located adjacent to said cockpit opening and lying between said cockpit opening and said bow of said watercraft; and, slidably releasable substantially rigid fastener means for attaching said deck plate means to said rigid upper deck and for slidably releasing said deck plate means from said rigid upper deck, wherein, when said deck plate means is released and removed from said watercraft a larger, extended cockpit opening is created, allowing ease of exit and entry by the operator, wherein, said fastener means comprises a single fastener means which runs along the edge of said deck plate means and which runs along the edge of said extended cockpit opening wherein a single force applied to the edge of said deck plate means in a direction substantially parallel to the plane of said deck plate means and in the direction of said bow causes said deck plate means to slidably release from said upper deck thereby substantially increasing the area of said cockpit opening in order to permit the operator of said watercraft to safely exit from said watercraft.

2. The apparatus of claim 1 wherein said single fastener means comprises an attachment flange along the entire edge of said extended cockpit opening which interlocks with a corresponding attachment flange which runs along the edge of said deck plate.

3. The apparatus of claim 1 wherein the sides of said extended cockpit opening taper inward towards the midline of said watercraft such that the forward width of said extended cockpit opening is smaller than the rearward width of said extended cockpit opening, and the sides of said deck plate means taper inward towards the midline of said watercraft such that the forward width of said deck plate means is smaller than the rearward width of said deck plate means.

4. The apparatus of claim 1 wherein said single fastener means comprises an attachment flange along the entire edge of said extended cockpit opening which interlocks with a corresponding attachment flange means which runs along the edge of said deck plate means and wherein, the sides of said extended cockpit opening taper inward towards the midline of said watercraft such that the forward width of said extended cockpit opening is smaller than the rearward width of said extended cockpit opening, and the sides of said deck plate means taper inward towards the midline of said watercraft such that the forward width of said deck plate means is smaller than the rearward width of said deck plate means.

5. The apparatus of claim 4 wherein the portion of said attachment flange means which runs along the edge of said extended cockpit opening comprises a cockpit flange which protrudes upward and outward away from the center of said extended cockpit opening, and wherein the portion of said attachment flange means which runs along the edge of said deck plate means comprises a deck plate flange which protrudes downward and inward towards the center of said deck plate means.

6. The apparatus of claim 5 wherein said cockpit flange is recessed below the level of the deck of said watercraft such that at the bottom of said cockpit flange said rigid upper deck extends upward and outward away from the center of said extended cockpit opening thereby creating a ramp which facilitates the attachment and release of said deck plate means.

7. The apparatus of claim 1 wherein said watercraft comprises a kayak.

8. A method of providing emergency escape from a watercraft, said watercraft having a bow, a substantially rigid upper deck and a cockpit opening, said cockpit opening comprising a hole in said rigid upper deck which surrounds the operator when the operator is seated in said watercraft and which allows operator entry into and exit from said watercraft, a substantially rigid deck plate means located adjacent to said cockpit opening and lying between said cockpit opening and said bow of said watercraft; and, slidably releasable substantially rigid fastener means for attaching said deck plate means to said rigid upper deck and for slidably releasing said deck plate means from said rigid upper deck, wherein, when said deck plate means is released and removed from said watercraft a larger, extended cockpit opening is created, allowing ease of exit and entry by the operator, wherein, said fastener means comprises a single fastener means which runs along the edge of said deck plate and which runs along the edge of said extended cockpit opening, wherein, said method comprises molding said releasable foredeck section and said single fastener means integrally with said watercraft wherein a single force applied to the edge of said deck plate means in a direction substantially parallel to the plane of said deck plate means and in the direction of said bow causes said deck plate means to slidably release from said upper deck thereby substantially increasing the area of said cockpit opening in order to permit the operator of said watercraft to safely exit from said watercraft.

* * * * *